US006158147A

United States Patent [19]

Smith et al.

[11] Patent Number: 6,158,147

[45] Date of Patent: Dec. 12, 2000

[54] METHOD AND APPARATUS FOR DRYING OF GRAIN AND OTHER PARTICULATES USING A MEMBRANE

[75] Inventors: Kevin W. Smith, McMurray, Pa.; Wayne Mueller, Airdrie, Canada

[73] Assignee: Clearwater, Inc., Pittsburgh, Pa.

[21] Appl. No.: 09/579,848

[22] Filed: May 25, 2000

Related U.S. Application Data

[63] Continuation-in-part of application No. 09/313,082, May 17, 1999.

[51] Int. Cl.[7] ..... F26B 3/00

[52] U.S. Cl. ..... 34/474; 34/475; 34/493; 34/168

[58] Field of Search ..... 34/413, 443, 467, 34/474, 475, 493, 496, 507, 60, 61, 72, 165, 168

[56] References Cited

U.S. PATENT DOCUMENTS

| | | | |
|---|---|---|---|
| 1,390,341 | 9/1921 | Cushing | 34/413 |
| 2,376,095 | 5/1945 | Shoeld | 34/476 |
| 2,465,162 | 3/1949 | Lockwood | 454/229 |
| 2,494,644 | 1/1950 | Clement | 95/127 |
| 2,535,902 | 12/1950 | Dailey, Jr. | 95/124 |
| 3,266,165 | 8/1966 | Apostle et al. | 34/424 |
| 3,621,585 | 11/1971 | Robertson | 34/375 |
| 4,189,848 | 2/1980 | Ko et al. | 96/128 |
| 4,230,463 | 10/1980 | Henis et al. | 55/16 |
| 4,783,201 | 11/1988 | Rice et al. | 55/16 |
| 4,894,068 | 1/1990 | Rice | 55/16 |
| 4,952,219 | 8/1990 | DiMartino | 55/16 |
| 5,122,355 | 6/1992 | Prasad et al. | 423/351 |
| 5,131,929 | 7/1992 | Brockmann et al. | 55/16 |
| 5,205,842 | 4/1993 | Prasad | 55/16 |
| 5,259,869 | 11/1993 | Auvil et al. | 95/52 |
| 5,282,969 | 2/1994 | Xu | 210/640 |
| 5,388,413 | 2/1995 | Major et al. | 62/11 |
| 5,632,805 | 5/1997 | Woodard | 96/4 |
| 5,641,337 | 6/1997 | Arrowsmith et al. | 95/39 |

OTHER PUBLICATIONS

"Membrane Dehydrador for High Pressure Gasas" D. G. Kalthod, D. J. Stokey and K. Jones, Permea Inc, 1997.

*Primary Examiner*—Pamela Wilson
*Attorney, Agent, or Firm*—William L. Krayer

[57] ABSTRACT

Very dry air is made for drying grain and other particulates. The air is dried by first cooling under pressure to remove moisture, then contacted with a drying device such as a vessel containing desiccant, then heated and released into a bed of particulates.

19 Claims, 7 Drawing Sheets

PRIOR
ART

METHOD AND APPARATUS FOR DRYING OF GRAIN AND OTHER PARTICULATES USING A MEMBRANE

RELATED APPLICATION

This application is a continuation-in-part of the application entitled "Drying of Grain and Other Particulate Materials" filed on May 17, 1999 by Matthew E. Vavro and Wayne Mueller, Ser. No. 09/313,082.

TECHNICAL FIELD

This invention relates to a method of drying materials. It is particularly applicable to grain such as wheat, and other crops. It involves passing through a bed of the grain, crops, or other materials a stream of very dry air. Preferred techniques for drying and circulating the air are disclosed.

BACKGROUND OF THE INVENTION

It is desirable to dry grain and other crops not only to reduce spoilage, but also to save on shipping charges based on weight, which otherwise would be calculated to include shipping the entire original moisture content of the grain or other agricultural product. Drying is also used to achieve a more or less standard or target moisture content, representing a regulatory or commercially desired maximum or optimum. Apart from any quality effects, it is undesirable to sell grain (and other products worth more than water) having a moisture content substantially less than such a maximum. Thus, it is common not only to reduce the moisture content of grain, but not to reduce it substantially below an acceptable maximum. This means the drying method must not only be efficient but readily controlled to achieve a target moisture content.

A rather basic method commonly used is simply to employ a large blower to force a stream of untreated atmospheric air through a silo or other container of grain. This method is subject to the vicissitudes and vagaries of weather conditions, particularly the temperature and relative humidity, and may actually add moisture to the grain rather than remove it. It is not efficient when the relative humidity is high, and generally cannot be used at night or at other times when temperatures are cool; therefore the operator may not be able to completely dry the grain in time to meet scheduled rail cars or other transportation. Also, the blowers must be quite large and will consume large quantities of power over time when relative humidity is high or when the back pressure is significant.

To increase the efficiency of atmospheric blowers, heaters for the air have been added, although simply heating does not remove moisture from the air but merely lowers the relative humidity. Some dryers using heated air also employ mechanical movers or manipulators of one type or another for the grain, so that the air need not pass through an entire bed of grain at once. If this is not done, the warm air has a tendency to deposit the moisture picked up from the lower (or upstream) part of a bed, into the upper (or downstream) part of the bed, as it is cooler than the warm air not carrying significant amounts of moisture. This means the warm air must do its job of picking up moisture more than once, an obviously inefficient result. To overcome this, the operator may increase the temperature further, which may tend to toast or at least over-dry the lower parts of the grain bed, reducing the value of the grain in more ways than one. And, the presence in the area of a flame to heat the air requires safety precautions because of the danger of explosions from grain dust. Fire hazards in such installations greatly increase insurance costs as well if insurance is available at all. Of course costs are increased by the additional equipment required for heating the air.

An early Cushing, U.S. Pat. No. 1,390,341, describes an air-tight silo having radial pipes with perforations used for the distribution of compressed air; the silo is first decompressed to create a vacuum, and the compressed air is then released into the silo, followed by the removal of moisture. The silo remains closed, however, and the compressed air is not passed through a bed of material but simply fills the silo. No means for drying the compressed air are shown. Compressed air is also used in a drying system by Element in U.S. Pat. No. 2,494,644.

In U.S. Pat. No. 4,189,848, inventors Grodzka and McCormick note that the conventional heated air techniques used for drying grain waste considerable energy, as the energy used to heat the air is released to the atmosphere after the process. Their answer is to circulate the air through a desiccant to aid in removing the moisture and they provide for the conservation of heat energy partly by recirculating the desiccant, which means dehydrating it for reuse. Desiccant is circulated also by Shoeld in U.S. Pat. No. 2,376,095.

Woodard, in U.S. Pat. No. 5,632,805, describes the assisted dehydration of compressed air through the use of various dehydrating devices, including a semipermeable membrane, interposed between compression stages in the compressor. No mention is made of using the air for drying grain or other agricultural products, nor is it suggested that the delivered air be heated for that purpose. Henis and Tripodi, in U.S. Pat. No. 4,230,463, review the history of membrane separation techniques beginning with cellulose acetate coatings for porous supports, used in desalination by reverse osmosis, and continuing with the early use of membranes for gas separation.

As summarized in the "Background" of Rice's U.S. Pat. No. 4,894,068, column 1, lines 23–36:

> ". . . (I)t is known to make relatively pure nitrogen from air by moving air under pressure into one end of an elongated container filled with a plurality of juxtaposed axially hollow membrane fibers running longitudinally of the container. Oxygen, carbon dioxide, water and other ("fast") gases will permeate through the membrane fibers, but nitrogen will permeate to a lesser extent. The gases passing through the membrane and separated from air are withdrawn from the downstream side of the membrane. As a result the portion of the air which does not permeate the membrane fibers after contact with the active membrane surface is relatively pure nitrogen.

The Rice '068 patent goes on to describe the use of hollow fiber membrane modules arranged serially for the introduction of air to achieve a nitrogen permeate having less than 1000 ppm oxygen.

The CACTUS® dryer manufactured by Permea, Inc., St. Louis Mo. is described by Rice et al in U.S. Pat. No. 4,783,201. As will be seen below, this device is useful in our invention. See also Brockmann et al U.S. Pat. No. 5,131,929.

SUMMARY OF THE INVENTION

Our process involves the compression, cooling, dehydration and warming of air prior to passing it through a bed of grain or other agricultural product to be dried; mechanical energy released on decompression is used to transport the air through the grain or other bed. The process takes advantage of the fact that the dehydration of compressed, cooled air is very efficient when conducted particularly in drying vessels designed for the purpose and with good desiccants or otherwise with known techniques. Air prepared by our process and warmed to a temperature of 80° F. to 120° F., having a relative humidity of less than two percent (2%), will quickly and reliably dry virtually any agricultural product or other bed of particulates it contacts.

Our process also includes the use of nitrogen-enriched air, made by passing air through a membrane, as described further below. Membranes are employed to remove both moisture and oxygen from the air, resulting in a dry gas comprising, preferably, at least 87% nitrogen, more preferably 90–99% nitrogen, with the most preferred range being 94–96 percent (by volume) nitrogen. Air is preferably compressed, to a pressure of up to 300 psi, and maintained at a temperature of 50 to 120° F. while it is contacted with the membrane. Water vapor and oxygen, in varying amounts depending on the composition and structure of the membrane, pass through it, leaving a gas of enhanced nitrogen content on the upstream side of the membrane. This enhanced nitrogen air is cooled, if necessary, to below 120° F. or, if desired and/or for particular types of grain (malting barley and seed grain) or other materials, to below 85° F. for two reasons—to further remove moisture, and to reduce the potential for injury to the grain or other material to be dried. The nitrogen-enriched air is then passed through a bin or other container of grain to dry it. The nitrogen, now carrying a significant portion of moisture, may be released to the atmosphere or recycled (see the discussion of FIG. 7 below). If it is recycled, the operator may wish to direct it to a desiccant dryer using chloride or bromide salts, formate salts, or regenerative desiccants such as silica gel, alumina or glycol systems. Alternatively, the recycled gas may be directed to a membrane specifically designed for moisture removal from high-nitrogen gas, since there will be little oxygen in it. The dried product of this membrane separator may be sent directly back to the grain bin or mixed with the original dried gas as it is sent to the grain bin, with or without temperature adjustment as is necessary or desirable.

The membrane drying step may be combined with desiccant and/or other types of drying steps, either in parallel or in series, as will be seen in FIGS. 5 and 6.

The above mentioned patents to Rice and Brockman et al, U.S. Pat. Nos. 4,894,068, 4,783,201, and 5,131,929, are incorporated herein by reference in their entireties, as they describe membrane separators and processes which are useful in our invention.

DETAILED DESCRIPTION OF THE INVENTION

Figure 1:
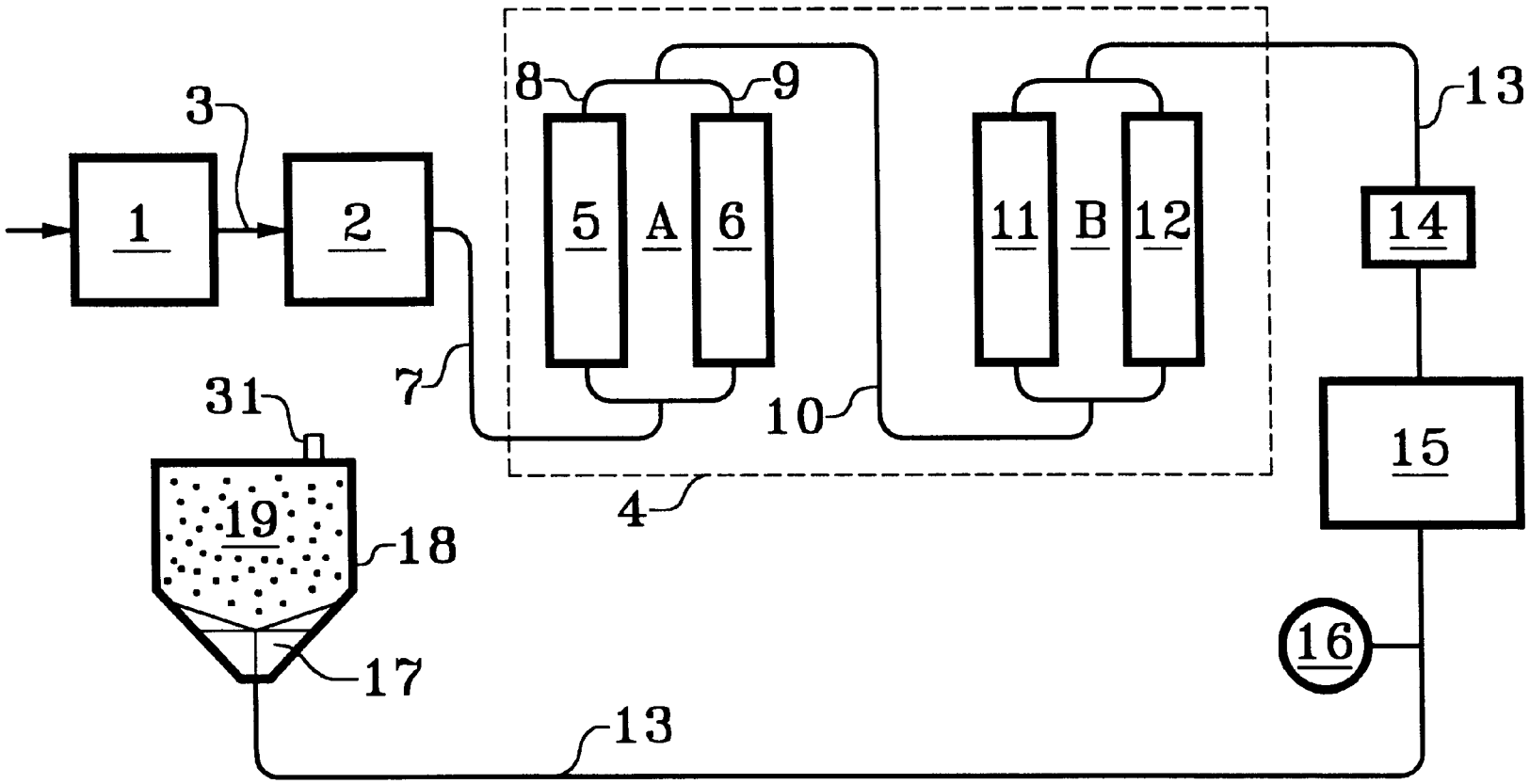
FIG. 1 is a flow sheet showing the compression, cooling, drying and warming of air followed by passing it through a bed of grain or other agricultural product as provided in our invention.

FIG. 1 is a more or less diagrammatic flow sheet showing how air is treated and used to dry a bin of grain according to our invention. About 350 to 700 standard cubic feet (scf) of ambient air is taken into compressor 1 per minute, compressed to achieve a pressure of about 100 to about 300 psia, preferably about 180 to about 220 psia. As is known, the process of compressing tends to warm the air, which is then continuously delivered to cooler 2 through line 3. Cooler 2 is capable of continuously cooling any amount of air delivered to it by compressor 1 to a temperature preferably from about 60° F. to about 80° F., or alternately preferably from about 5 to about 25 degrees F higher than the beginning temperature (more preferably about 8–13° F. higher than starting).

From cooler 2, the still pressurized and cooled air is delivered to dryer 4 which may have two drying zones designated as zone A and zone B. In this preferred configuration, zone A comprises two parallel drying vessels 5 and 6, both of which are fed directly by line 7 coming from cooler 2. Drying vessels 5 and 6 may be of any known design and preferably contain a desiccant; they may be of the design shown in FIG. 2. The initially dried air exits from drying vessels 5 and 6 through lines 8 and 9, which are joined in line 10, in turn divided for delivery of the still pressurized and cooled air to secondary drying vessels 11 and 12. After exiting from drying vessels 11 and 12 into combined line 13, the air is still cool (about 60° F. to 80° F.) and contains typically less than ten pounds of moisture per million scf. Back pressure regulator 14 may be used on line 13 to maintain the desired pressure in the system.

The air in line 13 proceeds to heater 15, which may be a water bath heater; it should be capable of continuously increasing the temperature of the air in line 13 from 70° F. to 120° F. at the desired flow rate. A meter 16 may be installed at this point to monitor the pressure, temperature and/or flow of the air. Line 13 is connected to air spreader 17 inside bin 18. Air spreader 17 may be a radial system of perforated pipes connected to line 13 so that the now warmed air may be spread relatively evenly throughout the bin. It is still pressurized in spreader 17 but the pressure is released through the perforations in spreader 17 and the warm air is accordingly jetted into the bed 19 of grain in the bin 18. It flows upwardly through the bed 19 and out through vent 31 or other outlet means.

Figure 2:
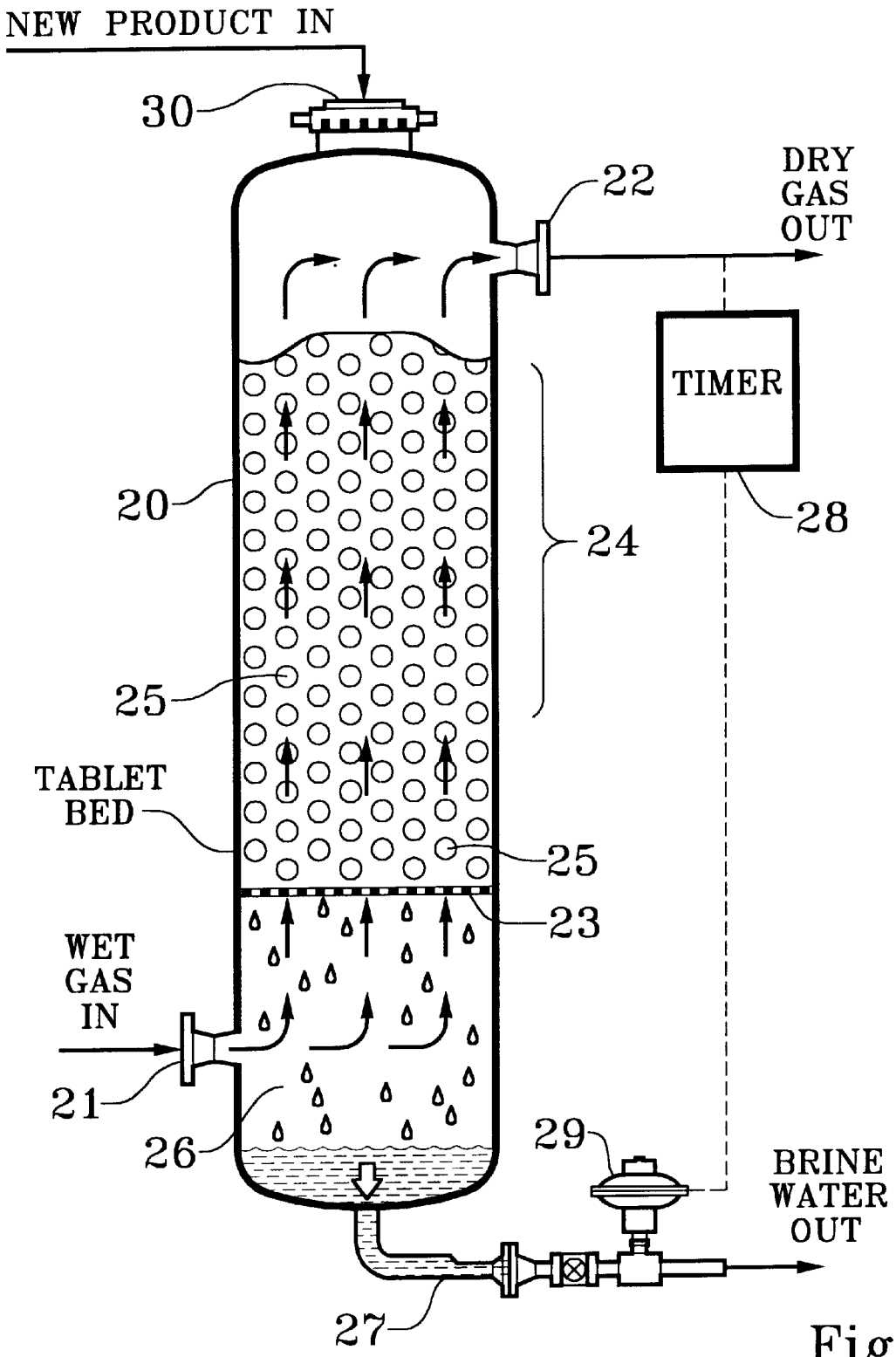
FIG. 2 is a detailed section of a prior art gas drying vessel which uses a desiccant.

The details of the preferred air drying vessel 5, 6, 11, and/or 12 are shown in FIG. 2. FIG. 2 shows drying vessel 20 having an inlet 21 for wet gas and an outlet 22 for dry gas. Perforated plate 23 holds a bed 24 of desiccant tablets 25, substantially filling the area above it. Wet gas entering inlet 21 is distributed by perforated plate 23 so that it flows substantially evenly through the bed 24, and desiccant tablets 25 are gradually dissolved as they pick up moisture from the air. The brine made by the dissolution of desiccant tablets 25 drains through perforated plate 23 into reservoir 26, which is connected to drainpipe 27. A timer 28 may open the valve 29 on the drainpipe 27 periodically or as a function of the flow of dry gas from outlet 22 as detected by a flowmeter or sensor not shown; or the drain may be operated in any other desired manner to prevent excess accumulation of brine in reservoir 26. The desiccant tablets 25 are periodically replenished by addition through opening 30. The desiccant tablets 30 may be such as those described by Thomas in U.S. Pat. No. 5,733,841 or any other suitable desiccant materials or forms. While the vessel described in connection with FIG. 2 is a preferred one, any other suitable vessel for holding desiccant and flowing air through it in contact with the desiccant may be used.

Persons skilled in the art of drying air will realize that the air from line 13 passing through spreader 17 will be quite dry. Moisture is first removed from the ambient air by the act of compressing in compressor 1. Liquid water can be drained or otherwise removed in the compressor in known ways such as drips, filters, or settling reservoirs. Cooling in cooler 2 will also remove moisture by lowering the temperature below the saturation point (dew point) in most cases; again, liquid water can be removed continuously from the cooler in a known manner by drains, drips, filters, and the like. Drying vessels 5, 6, 11, and 12 are of course designed to remove significant amounts of the remaining moisture from the air, with the assistance of desiccants or various devices known in the art for the purpose of drying. This step is made more efficient by the early removal of moisture in the compressing and cooling steps. Accordingly, when the air leaves drying zone B, it will have less than ten pounds of moisture per million cubic feet of air (scf) and, after it is heated, typically to 110° or other temperature within the range 80–120° F. and reduced to near atmospheric pressure in bin 18, its relative humidity will be, for example, 0.25%. This is an extremely efficient drying air for contact with the grain bed 19. Finally, the drying air is not simply passed through the bed 19, but is virtually propelled through it by the release of mechanical energy caused by passing through the perforations in spreader 17, due to the pressure drop as it leaves relatively high pressure line 13 and enters the far lower (near-atmospheric) pressure of vented grain bin 18.

While the above described method and apparatus are preferred, it should be noted that certain variations are within our invention. For example, cooling and drying steps can be conducted prior to compressing, depending on the specific local availabilities of the equipment. The heater can be any kind of heater, but a water bath heater is preferred because of its efficiency and convenience; nevertheless, heating of the air may be accomplished in a number of ways, such as by electrical, solar and other energy sources. Good engineering practice may suggest that the heater and cooler work in close association to conserve energy. Drying need not be done by a desiccant-equipped vessel, but also could be done by a vessel having a semipermeable membrane as in the above mentioned U.S. Pat. No. 5,632,805 and/or other membrane devices usable for separating nitrogen from the air—the nitrogen may be dried and/or otherwise treated as the air in our process, bringing with it the advantages of reducing the possibility that the grain may be oxidized and reducing the possibility of explosion hazards from contact of the air with dry grain dust. The air spreader 17 may include nozzles and may direct the dried air downward into the silo rather than upwards while the vent 31 still provides an outlet for the upwardly flowing air; in another variation, air spreader 17 may be deployed on or near the top of bin 18 and vents or other outlets provided in the bottom of the bin 18.

We prefer the illustrated configuration for the dryer in which there are two parallel drying vessels in two stages; however, other configurations may be used for circulating the air through the drying vessels. For example, only two or more vessels of appropriate sizes may be connected in series or parallel or any combination of series or parallel.

Figure 3:
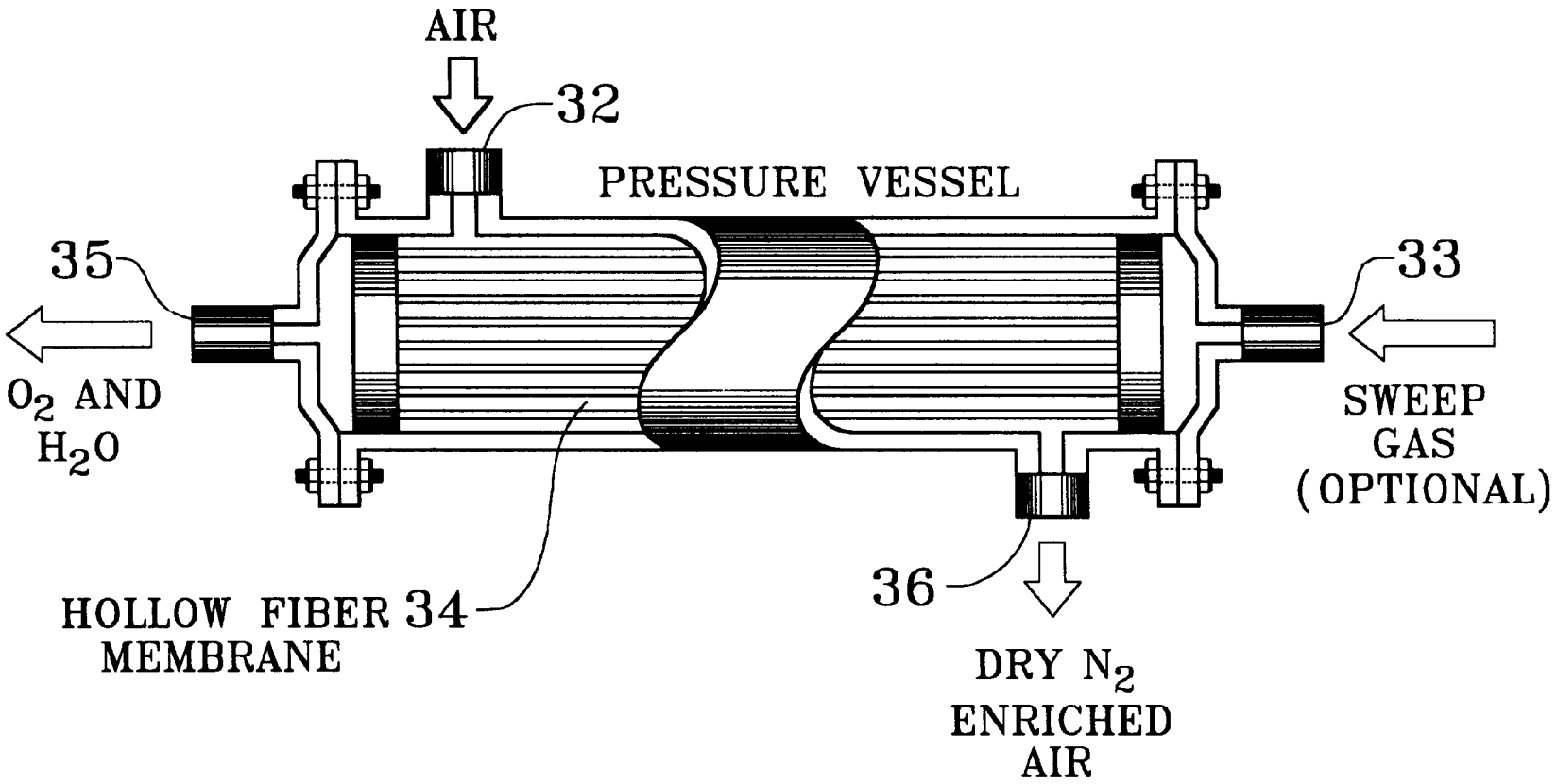
Fig. 3 PRIOR ART
FIG. 3 is a flow diagram of a prior art membrane gas separator useful in our invention.

Referring now to FIG. 3, the flow diagram is of a membrane separator of a type described by Rice et al in U.S. Pat. No. 4,783,201. Air enters inlet 32 under the pressure and temperature conditions described above, preferably adapted for the specifications of the particular model of membrane separator. For our relatively high volume applications, we prefer to utilize upstream pressures of from 50 to 300 psi and temperatures of 90 to 120° F. The typical commercial membrane separator also has an inlet 33 for sweep gas. However, we do not normally use a sweep gas, and our discussion will continue without reference to it. In the pressure ranges we use, the air will be impressed on the shell side of the hollow membrane fibers 34, and the permeate removed from the inside of the hollow membrane fibers. As described above, most of the moisture and a substantial portion of the oxygen is removed from the air by permeation through the hollow fiber membranes 34, passing out of the unit through exit 35. This permeate is normally discarded, but it may be used to enhance combustion, for example, in heater 15. The desired dry enriched air , comprising at least 87% nitrogen by volume, is removed at exit 36.

Figure 4:
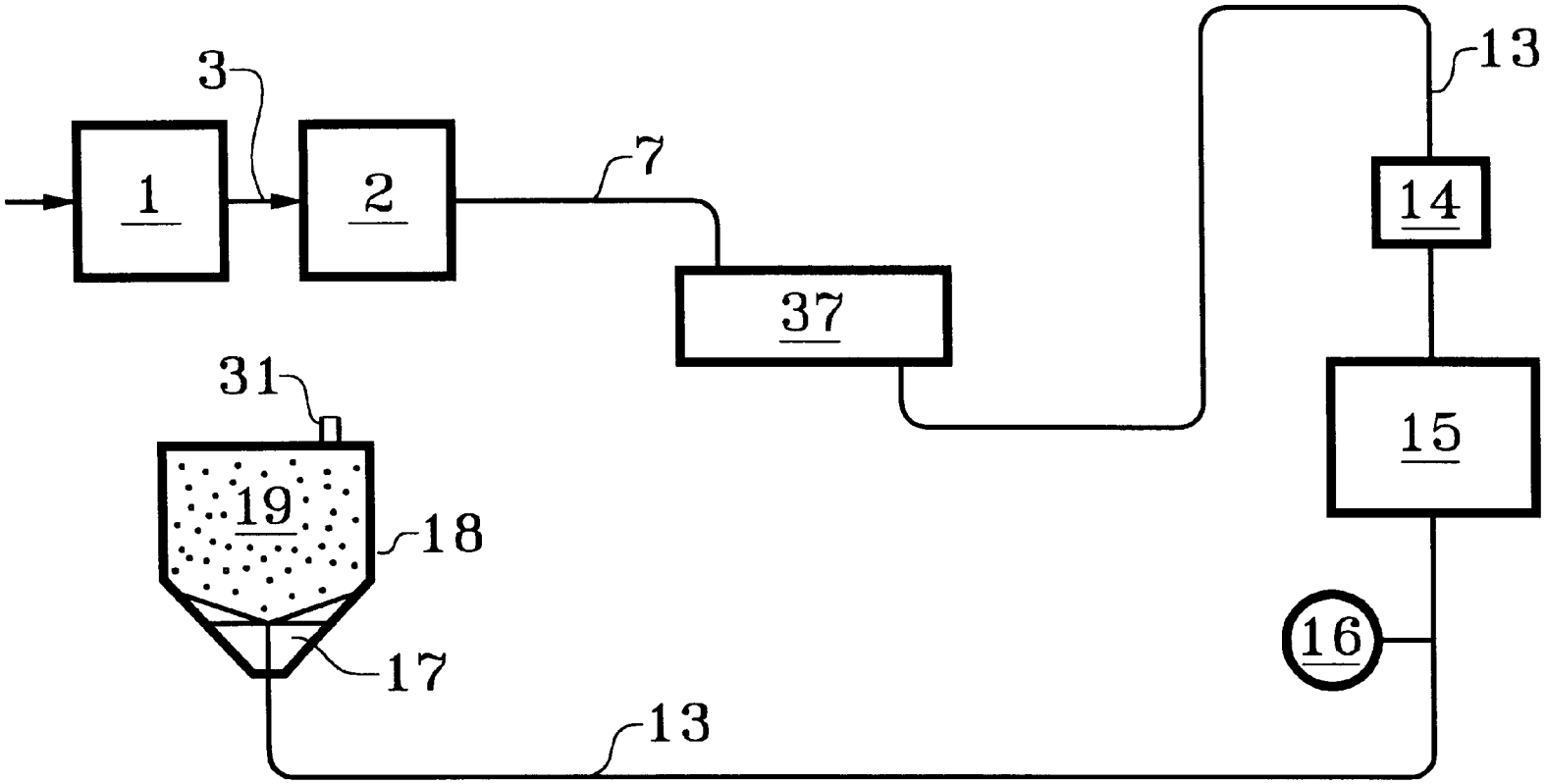
FIG. 4 shows an overall flow diagram with the membrane separator in place to perform a nitrogen-enrichment and drying step on the feed air.

In FIG. 4, the membrane separator of FIG. 3, here designated 37, is in place in our system for drying grain or other granular materials. As in FIG. 1, air is introduced to a compressor 1 and cooler 2, passing from cooler 2 through line 7 to membrane 37. The resulting dry, nitrogen-enriched air is then moved through line 13 for use in bin 18 as in FIG. 1.

Figure 5:
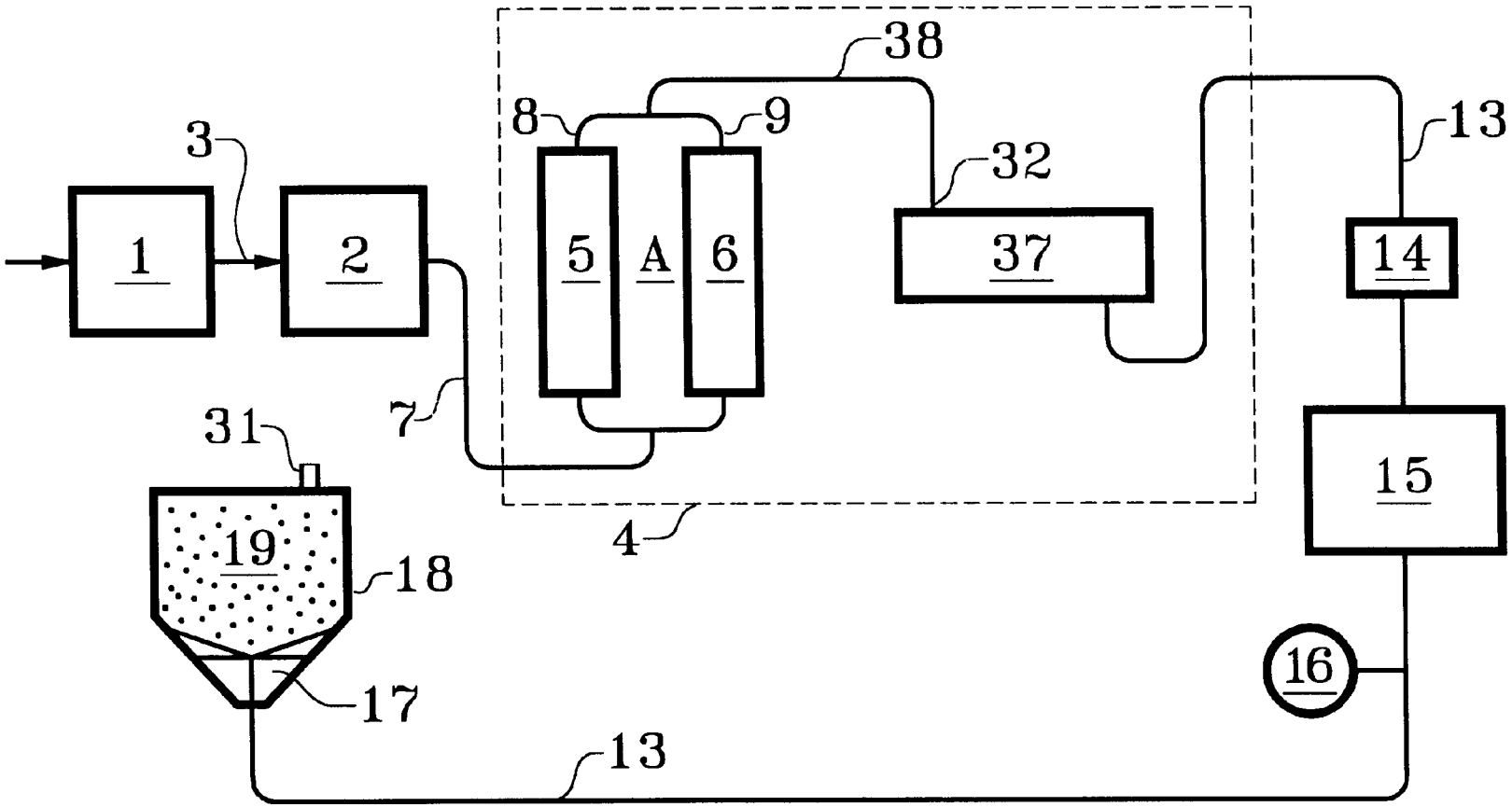
FIG. 5 shows a modified process combining membrane and desiccant steps in series.

The variation of our invention in FIG. 5 combines the membrane separator 37 with a desiccant drier in zone A as described in FIG. 1. The two drying systems are connected in series—that is, line 38 carries the partially dried air from zone A to the air inlet 32 of membrane separator 37, and line 13 carries the finished, nitrogen-enriched, product to bin 18 where it dries grain 19 as previously described.

Figure 6:
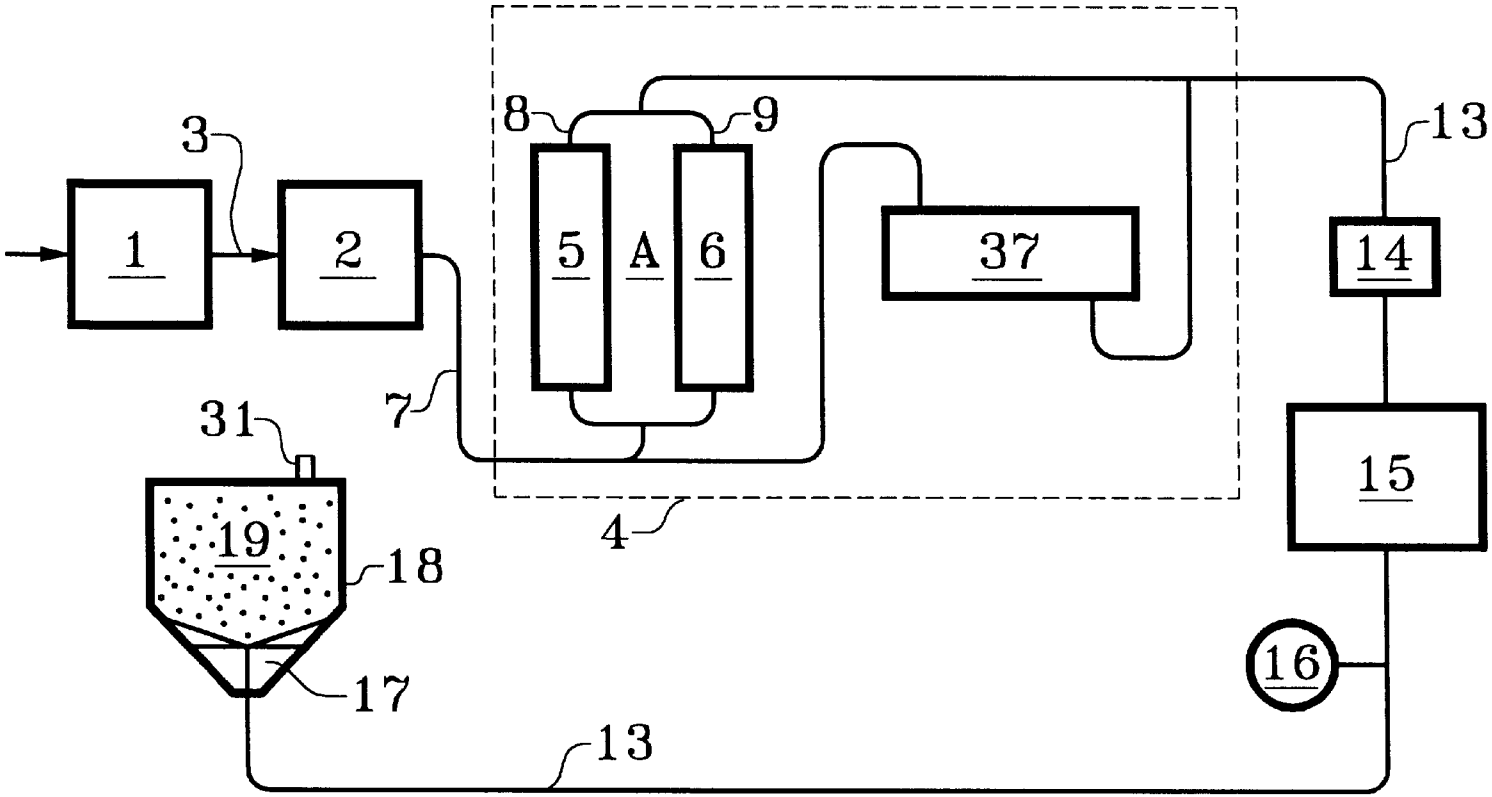
FIG. 6 is a flow diagram showing a combination of desiccant and membrane drying steps in parallel.

The flow diagram of FIG. 6 shows the drying apparatus of zone A as described in FIG. 1 connected in parallel to membrane separator 37. That is, line 7 feeds air to both the zone A desiccant dryer and membrane separator 7, and line 13 receives dry product from both for sending to bin 18.

Figure 7:
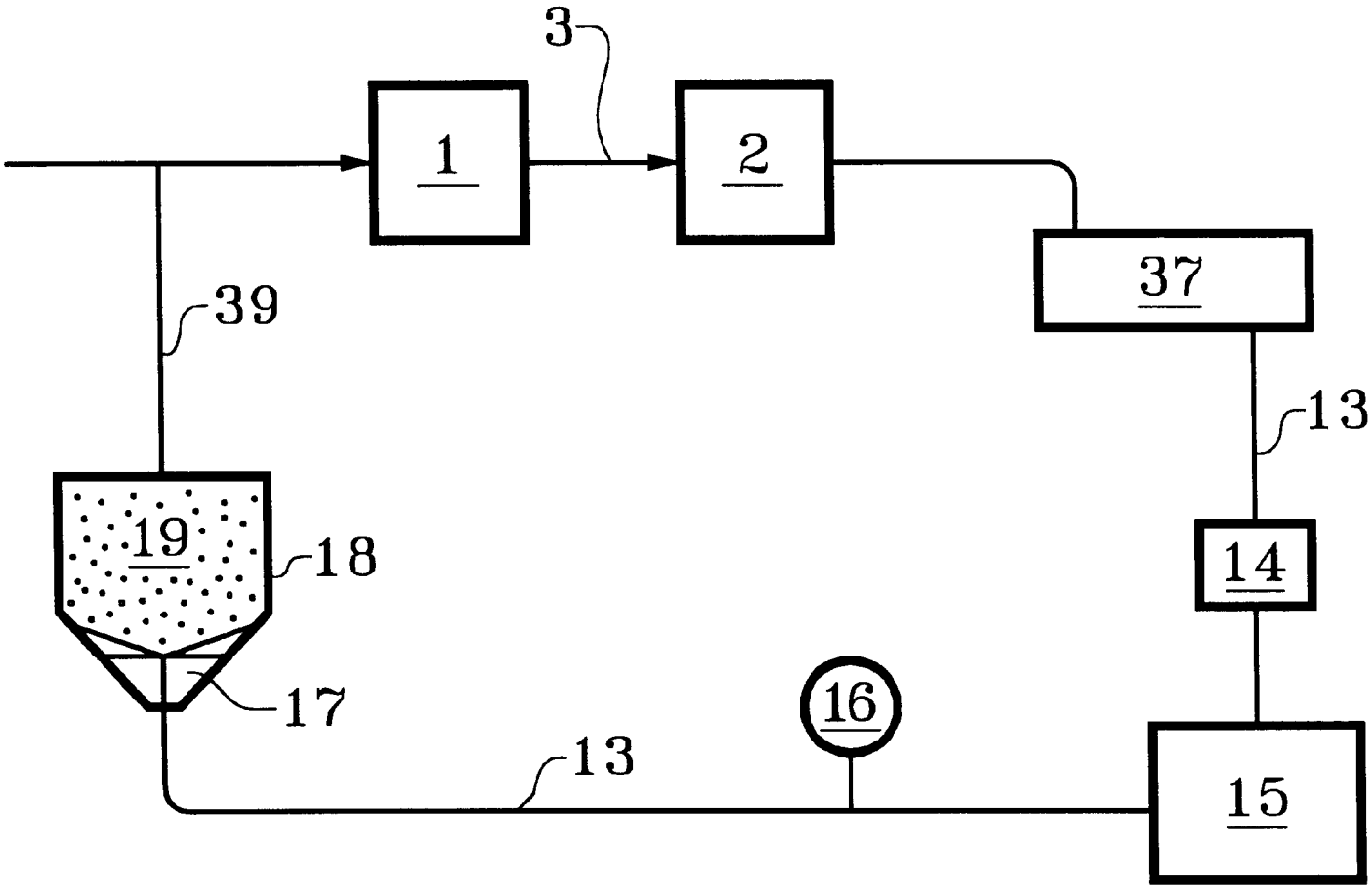
FIG. 7 shows a variant of our invention in which the nitrogen-enriched air is recycled from a grain bin.

In FIG. 7, the system is configured to recycle used gas from bin 18 to the inlet of compressor 1. Even though the used gas in line 39 will contain moisture from the bed 19, it can be advantageous to recycle particularly the low-oxygen gas obtained through the membrane separator 37, since on recycle it will not have to remove much, if any, oxygen. Thus membrane separator 37 will be more efficient. Recycling may also be used in any of the other configurations of FIGS. 1, 4, 5, and 6 but is preferred where only membrane separation is used, i.e. where higher levels of nitrogen content are obtained from the membrane separator.

In the "high-nitrogen" variation of our invention, i.e. the modes shown in FIGS. 3–7, we make a permeate gas comprising at least 87% nitrogen by volume having a dew point below 50° C. Preferably the permeate, or output gas is 90–99% (by volume) nitrogen; most preferably, it is 94–96% nitrogen.

Where a membrane is used, the air processed by it will preferably be held at a temperature between 90 and 120° F. in the vicinity of the membrane. After processing by the membrane, the high-nitrogen non-permeate is cooled for two reasons—to further remove moisture, and to guard against injury to the grain. If the material to be dried will not be injured by a relatively high temperature, the drying gas need not be cooled. For grain such as wheat, temperatures above 120° are not recommended, as they may be expected to overheat the grain; however, the nitrogen-enriched air we prefer is less likely to damage the grain than ordinary air because of the reduced oxygen content. For other, more temperature-sensitive grains such as malting barley and seed grains, the user may wish to maintain temperatures lower than 85° F.

Another advantage of using our process is that the nitrogen-rich drying gas is far less likely than air to cause an explosion in the dust-laden atmosphere of a silo or other storage vessel for grain. For this purpose, we utilize a gas comprising at least 87% nitrogen by volume and no more than 2% oxygen. Our oxygen-poor gas also discourages the growth of microorganisms such as mold and bacteria in the grain and on the walls of the silos.

Persons skilled in the agricultural drying art will recognize that the efficiency of our process means that the time required for drying grains and other agricultural products is significantly reduced, resulting in readily realizable economic benefits. For example, train stations are able to move more grain through their capital equipment in a given period of time than would be otherwise possible; likewise the farmer will be able to devote his time to other matters, which can be quite critical when the weather dictates. Other economic and practical benefits derived from the relatively inexpensive and relatively safe equipment and its portability will become apparent to the user. For example, the high air temperatures mentioned above which are used to augment the function of conventional blowers are not needed with our invention, and damage to the grain is accordingly avoided.

Our invention is not limited to the drying of agricultural crops and the like, but may be used for drying any large volume of materials, such as particulate synthetic resins which have been made in an aqueous suspension, lumber, fibers, sawdust, bark, coffee, and the like.

What is claimed is:

1. Method of drying particulate materials in a holding vessel having a gas inlet and a gas outlet comprising (a) preparing air having a pressure from 50 to 300 psi and a temperature from 90 to 120° F., (b) passing said air through a membrane gas separator to remove water vapor and oxygen therefrom to obtain a drying gas, (c) reducing the temperature of said drying gas and (d) passing said drying gas through said holding vessel to contact said particulate materials by passing said drying gas through said gas inlet and said gas outlet of said holding vessel.

2. Method of claim 1 wherein the temperature of said drying gas is reduced in step (c) to a temperature below 120° F.

3. Method of claim 1 wherein water is also removed from said air in step (a).

4. Method of claim 1 wherein water is also removed from said air in step (c).

5. Method of claim 1 wherein said particulate materials comprise grain.

6. Method of claim 1 wherein said particulate materials comprise wheat.

7. Apparatus for drying grain comprising (a) means for compressing air to a pressure of 50 to 300 and adjusting its temperature to a temperature of 50 to 120° F. (b) membrane means for removing water vapor and oxygen from said air, said membrane means having a permeate side and a non-permeate side, and (c) means for passing gas from said non-permeate side of said membrane means through said grain.

8. Apparatus of claim 7 including means for reducing the temperature of said gas from said non-permeate side in element (c).

9. Apparatus of claim 7 including means for removing water from said air in element (a).

10. Apparatus of claim 7 wherein said gas is air and said membrane means is capable of producing air having a water vapor dew point of less than −90° C.

11. Apparatus of claim 7 including means for recovering said gas after it passes through said grain and further passing said gas through a membrane for removing water therefrom.

12. Method of drying grain in a holding vessel having a gas inlet and a gas outlet comprising (a) preparing air having a pressure from 50 to 300 psi and a temperature from 90 to 120° F., (b) passing said air through a membrane gas separator to remove water vapor and oxygen therefrom to obtain a drying gas, and (c) passing said drying gas at a temperature less than 120° F. through said holding vessel to contact said particulate materials by passing said drying gas through said gas inlet and said gas outlet of said holding vessel.

13. Method of claim 12 wherein said drying gas comprises at least 87% nitrogen by volume and has a dew point below 50° C.

14. Method of claim 13 wherein said drying gas comprises 90–99% nitrogen by volume.

15. Method of claim 14 wherein said drying gas comprises 94–96% nitrogen by volume.

16. Method of claim 12 including passing said gas from said outlet of said holding vessel to a membrane gas separator to remove water therefrom and passing said gas to said inlet of said holding vessel.

17. Method of claim 12 including recycling gas from said gas outlet to said membrane gas separator.

18. Method of claim 12 wherein said grain is malting barley and said gas is passed through said holding vessel at a temperature below 85° F.

19. Method fo claim 12 wherein said grain is seed grain and said gas is passed through said holding vessel at a temperature below 85° F.

* * * * *